US007942038B2

(12) United States Patent
Ziminsky et al.

(10) Patent No.: US 7,942,038 B2
(45) Date of Patent: May 17, 2011

(54) SYSTEMS AND METHODS OF MONITORING ACOUSTIC PRESSURE TO DETECT A FLAME CONDITION IN A GAS TURBINE

(75) Inventors: Willy Steve Ziminsky, Simpsonville, SC (US); Anthony Wayne Krull, Anderson, SC (US); Timothy Andrew Healy, Simpsonville, SC (US); Ertan Yilmaz, Glenville, NY (US)

(73) Assignee: General Electric Company, Schenectady, NY (US)

( * ) Notice: Subject to any disclaimer, the term of this patent is extended or adjusted under 35 U.S.C. 154(b) by 320 days.

(21) Appl. No.: 12/356,828

(22) Filed: Jan. 21, 2009

(65) Prior Publication Data

US 2010/0180674 A1 Jul. 22, 2010

(51) Int. Cl.
*G01M 15/14* (2006.01)

(52) U.S. Cl. ..... 73/112.01

(58) Field of Classification Search ..... 73/112.01, 73/112.03, 112.04
See application file for complete search history.

(56) References Cited

U.S. PATENT DOCUMENTS 5,961,314 A * 10/1999 Myhre et al. ..... 431/79
6,164,055 A 12/2000 Lovett et al.
6,357,216 B1 3/2002 Scott et al.
6,438,961 B2 8/2002 Tuthill et al.
6,708,568 B2 3/2004 Gleeson et al.
6,848,319 B2 2/2005 Gleeson et al.
6,857,320 B2 2/2005 Gleeson et al.
6,978,680 B2 12/2005 Gleeson et al.
7,017,415 B2 3/2006 Harrold et al.
7,111,463 B2 9/2006 Sprouse et al.
2006/0046218 A1 3/2006 Joklik et al.
2007/0000228 A1* 1/2007 Ohri et al. ..... 60/39.37
2007/0006596 A1 1/2007 Fujii
2010/0175384 A1* 7/2010 Kraemer et al. ..... 60/773
2010/0180564 A1* 7/2010 Ziminsky et al. ..... 60/39.1
2010/0275573 A1* 11/2010 Frederick ..... 60/39.091
2010/0280732 A1* 11/2010 Singh et al. ..... 701/100

OTHER PUBLICATIONS

McManus, et al., Modeling and Control of Combustion Dynamics in Industrial Gas Turbines, Proceedings of ASME Turbo Expo 2004, Power of Land, Sea and Air, Jun. 14-17, 2004, Vienna, Austria.

* cited by examiner

*Primary Examiner* — Eric S McCall
(74) *Attorney, Agent, or Firm* — Sutherland Asbill & Brennan LLP

(57) ABSTRACT

A method may detect a flashback condition in a fuel nozzle of a combustor. The method may include obtaining a current acoustic pressure signal from the combustor, analyzing the current acoustic pressure signal to determine current operating frequency information for the combustor, and indicating that the flashback condition exists based at least in part on the current operating frequency information.

20 Claims, 3 Drawing Sheets

SYSTEMS AND METHODS OF MONITORING ACOUSTIC PRESSURE TO DETECT A FLAME CONDITION IN A GAS TURBINE

FEDERALLY SPONSORED RESEARCH OR DEVELOPMENT

This invention was made with Government support under Contract No. DE-FC26-05NT42643 awarded by the U.S. Department of Energy. The Government has certain rights in this invention.

TECHNICAL FIELD

The present disclosure generally relates to systems and methods of detecting a flashback condition in a gas turbine, and more particularly relates to systems and methods of monitoring acoustic pressure to detect a flashback condition in a pre-mixed fuel nozzle of a combustor.

BACKGROUND OF THE INVENTION

A gas turbine generally includes a compressor, a combustion system, and a turbine section. Within the combustion system, air and fuel are combusted to generate an air-fuel mixture. The air-fuel mixture is then expanded in the turbine section.

Traditionally, combustion systems have employed diffusion combustors. In a diffusion combustor, fuel is diffused directly into the combustor where it mixes with air and is burned. Although efficient, the diffusion combustor is operated at a relatively high peak temperature, which creates relatively high levels of pollutants such as nitrous oxide (NOx).

To reduce the level of NOx resulting from the combustion process, dry low NOx combustion systems have been developed. These combustion systems use lean pre-mixed combustion. With lean pre-mixed combustion, air and fuel are premixed in a fuel nozzle to create a relatively uniform air-fuel mixture. The fuel nozzle then injects the air-fuel mixture into the combustion chamber, where the air-fuel mixture is combusted at a relatively lower, controlled peak temperature.

Although such combustion systems achieve lower levels of NOx emissions, the fuel nozzles may be relatively likely to develop a flashback condition, wherein a flame stabilizes in one or more of the fuel nozzles. One common reason for a flashback condition in the fuel nozzle is an upstream flame propagation event, wherein flame propagates from an expected location in the combustion chamber upstream to the fuel nozzle. Another common reason for a flashback condition in the fuel nozzle is auto-ignition, wherein the air-fuel mixture in the nozzle independently ignites. Regardless of the cause, the flame may tend to stabilize within the fuel nozzle, which may damage the fuel nozzle or other portions of the gas turbine if the damaged hardware is liberated into the flow path.

To address this problem, combustion systems are normally designed to be flashback resistant, meaning to prevent a flame from stabilizing in the fuel nozzle. However, flashback resistant combustion systems have not been achieved for use with reactive fuels such as hydrogen, which are relatively more likely to experience flashback conditions than conventional fuels such as natural gas. The lack of flashback resistant combustions systems for reactive fuels limits their practicality, despite environmental benefits of their use.

What the art needs is systems and methods of detecting a flashback condition in a component of a gas turbine, such as a fuel nozzle of a dry-low NOx combustor burning hydrogen-rich fuel, so that appropriate corrective measures can be taken before damage is sustained.

BRIEF DESCRIPTION OF THE INVENTION

A method may detect a flashback condition in a fuel nozzle of a combustor. The method may include obtaining a current acoustic pressure signal from the combustor, analyzing the current acoustic pressure signal to determine current operating frequency information for the combustor, and indicating that the flame condition exists based at least in part on the current operating frequency information.

Other systems, devices, methods, features, and advantages of the disclosed systems and methods will be apparent or will become apparent to one with skill in the art upon examination of the following figures and detailed description. All such additional systems, devices, methods, features, and advantages are intended to be included within the description and are intended to be protected by the accompanying claims.

BRIEF DESCRIPTION OF THE DRAWINGS

The present disclosure may be better understood with reference to the following figures. Matching reference numerals designate corresponding parts throughout the figures, and components in the figures are not necessarily to scale.

DETAILED DESCRIPTION OF THE INVENTION

Described below are embodiments of systems and methods of monitoring acoustic pressure to detect a flashback condition in a gas turbine, such as in a fuel nozzle of a combustor of the gas turbine. The flashback condition may result from an upstream flame propagating into the fuel nozzle and/or an air-fuel mixture auto-igniting in the fuel nozzle. The systems and methods may detect the flashback condition by monitoring and analyzing an acoustic pressure signal in the combustion chamber. The acoustic pressure signal may include frequency spikes associated with dynamic pressure waves propagating through the combustion chamber. The frequency spikes may differ from frequencies associated with normal operation of the combustor, or the frequency spikes may match frequencies associated with abnormal operation of the combustor. In either case, the flashback condition may be indicated.

Thus, to detect a flashback condition in any one of the fuel nozzles of the combustor, it may not be necessary to associate a sensor with each fuel nozzle, as the detection occurs at the combustor level instead of the nozzle level. Such a configuration may reduce the cost associated with flashback detection. In embodiments, the systems and methods may employ a probe that serves other functions. For example, the probe may include a combustion dynamics monitoring (CDM) probe suited for monitoring dynamic pressure in the combustor. In such cases, it may be relatively easy and inexpensive to retrofit a gas turbine with the system.

Figure 1:
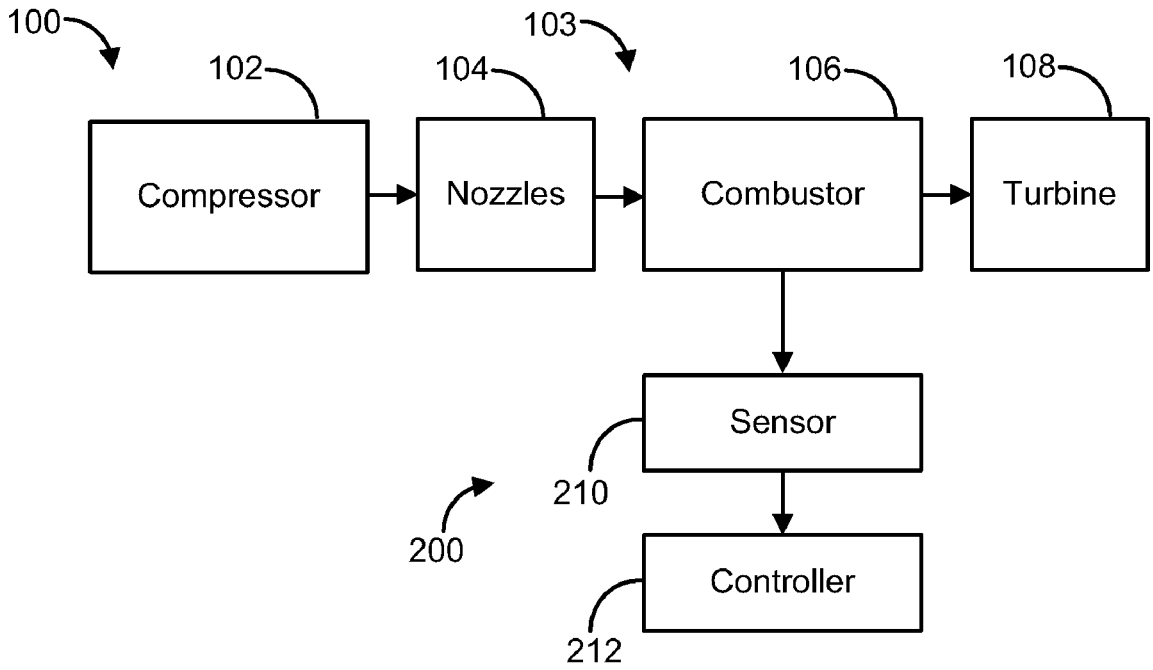
FIG. 1 is a block diagram illustrating an embodiment of a system for detecting a flashback condition in a fuel nozzle of a combustor.

FIG. 1 is a block diagram illustrating an embodiment of a system 200 for detecting a flashback condition in a gas turbine 100. Typically, the gas turbine includes a compressor 102, a combustion system 103, and a turbine section 108, as shown. The compressor 102 may compress incoming air to a high pressure. The combustion system 103 may burn the compressed air with fuel to create a hot gas. The turbine section 108 may expand the hot gas to drive a load, and in some cases, the compressor 102.

Typically, the combustion system 103 includes a number of combustors 106 circumferentially spaced about the turbine section 108. Each of the combustors 106 is supported by a number of fuel nozzles 104, which are arranged in parallel at an entrance to the combustor 106.

In some cases, the combustion system 103 may be a dry low NOx combustion system, which may be relatively more environmentally friendly than a diffusion combustion system. With dry low NOx combustion, each combustor 106 may be a dry low NOx combustor and the corresponding fuel nozzles 104 may be pre-mixer nozzles. In operation, the compressed air from the compressor 102 may be mixed with fuel in the fuel nozzles 104 to form an air-fuel mixture. Subsequently, the fuel nozzles 104 may discharge the air-fuel mixture into the corresponding combustor 106, which features a combustion chamber or "can" that serves as a controlled envelope for efficient burning of the air-fuel mixture.

For the purposes of simplicity, the combustion system 103 of the gas turbine 100 is shown in FIG. 1 and is described below with reference to one fuel nozzle 104 and one combustor 106, although a person of skill would understand that the combustion system 103 generally includes a number of combustors 106 in parallel, each of which is supported by a number of fuel nozzles 104 in parallel.

Typically, operation of the combustion system 103 is marked by certain combustion dynamics. Specifically, the gases inside the combustor 106 may form dynamic pressure waves during the combustion process. The dynamic pressure waves may propagate through the combustion chamber according to certain known or expected frequencies. These dynamic pressure waves are interchangeably referred to herein as acoustic pressure waves. In some instances the dynamic pressure waves may propagate at frequencies in the audible range, such that operation of the combustor 106 is marked by a distinctive sound. Most conventional gas turbines are fitted with equipment for monitoring the dynamic pressure waves, as a disturbance in the dynamic pressure waves may indicate a disturbance in the combustion system 103. Also, the dynamic pressure waves may cause a disturbance in the combustion system 103, such as excessive vibrations. As described below with reference to FIG. 2, the monitoring equipment may include a dynamic pressure sensor or transducer associated with the combustor 106, although other configurations are possible. The monitoring equipment may obtain an acoustic pressure signal from the combustor 106, which is representative of the combustion dynamics occurring therein.

In addition to undesirable combustion dynamics, the combustion system 103 may be may be susceptible to developing a flashback condition in one or more of the fuel nozzles 104. As used herein, the term "flashback condition" denotes a sustained flame burning in a fuel nozzle 104. The flashback condition may develop for a variety of reasons, including an upstream flame propagation event, wherein flame travels from the combustor 106 into the fuel nozzle 104, and an auto-ignition event, wherein flame automatically ignites within the fuel nozzle 104. Flashback conditions are relatively more likely to occur in dry low NOx combustion systems, particularly those that employ relatively reactive fuels such as hydrogen.

Some flashback conditions may be marked by an associated disturbance or change in the combustion dynamics of the combustion system 103. Specifically, the dynamic pressure waves may oscillate or propagate according to different or unexpected frequencies in advance of or in response to the development of a flame condition. For example, the dynamic pressure waves may respond to an existing flashback condition by changing or shifting frequency, or alternatively, a frequency shift or change in the dynamic pressure waves may cause a disturbance in the combustion system 103 that results in a flashback condition. Combinations of these effects may also occur.

In such cases, monitoring the dynamic pressure waves may permit detecting the occurrence of a flashback condition in the fuel nozzle 104. Remedial action may then be taken to reduce or extinguish the flashback condition, which may be beneficial in cases in which the combustion system 103 is not designed to withstand or avoid flashback conditions, such as in cases in which a dry low NOx combustion system is operated using hydrogen fuel.

Thus, FIG. 1 also illustrates a system 200 for detecting a flashback condition in the combustion system 103 of the gas turbine 100. As shown, the system 200 generally includes an acoustic pressure sensor 210 and a controller 212. The acoustic pressure sensor 210 may be any sensor, transducer, probe, or microphone operable to detect, obtain, or monitor an acoustic pressure signal from the combustor 106. For example, the acoustic pressure sensor 210 may be a probe having a transducer, which may detect dynamic pressure waves within the combustor 106 and may encode the detected dynamic pressure waves in an electric signal.

The system 200 may also include a controller 212. The controller 212 may be implemented using hardware, software, or a combination thereof for performing the functions described herein. By way of example, the controller 212 may be a processor, an ASIC, a comparator, a differential module, or other hardware means. Likewise, the controller 212 may include software or other computer-executable instructions that may be stored in a memory and may be executable by a processor or other processing means.

The acoustic pressure sensor 210 may communicate the acoustic pressure signal to the controller 212. The acoustic pressure sensor 210 may be in electrical communication with the controller 212 for this purpose. The controller 212 may be operable to analyze the acoustic pressure signal detected from the combustor 106 to identify one or more dominant frequencies associated with current operation of the combustion system 103. For example, the controller 212 may perform a signal processing technique on the detected acoustic pressure signal. The signal processing technique may include a spectral analysis configured to represent the acoustic pressure signal in the frequency domain. Examples of such signal processing techniques include fast Fourier transform, short-term Fourier transform, windowed Fourier transform, wavelet transform, and Laplace transform, although other techniques may be used herein. By processing the acoustic pressure signal in the frequency domain, the controller 212 may identify the one or more dominant frequencies associated with the current operation of the combustion system 103. The controller 212 may employ these frequencies to determine whether a flame condition exists in the combustion system 103.

The controller 212 may also be operable to indicate a flashback condition exists in the combustion system 103, based at least in part on the one or more dominant frequencies associated with the current operation of the combustor 106.

In some embodiments, the controller 212 may indicate the flashback condition exists in the combustion system 103 in response to the current operating frequency information differing from frequency information indicative of normal operation. More specifically, during normal operation of the combustion system 103 the acoustic pressure signal of the combustor 106 may be marked by certain baseline frequencies. These baseline frequencies may have values that are known or are ascertainable through ordinary experimentation. For example, the baseline frequencies may be determined by operating the combustion system 103 under normal conditions, obtaining a baseline acoustic pressure signal from the combustor 106, and analyzing the baseline acoustic pressure signal to identify the baseline frequencies.

Thereafter, the baseline frequency information may be accessed by the controller 212 for comparison purposes during operation of the system 200 for detecting the flame condition. For example, the baseline frequency information may be stored in a program of operation executed by the controller 212 or in a memory accessible by the controller 212. After the controller 212 analyzes the current acoustic pressure signal to determine the current operating frequency information, the controller 212 may compare the current operating frequency information with the baseline frequency information indicative of normal combustor operation. In the event that the current operating frequency information differs from the baseline frequency information in whole or in part, the controller 212 may indicate a flashback condition exists in the combustion system 103, such as in one of the fuel nozzles 104.

In other embodiments, the controller 212 may indicate the flashback condition exists in the combustion system 103 in response to the current operating frequency information corresponding to abnormal frequency information indicative of a flashback condition. More specifically, the acoustic pressure signal of the combustor 106 may be marked by certain abnormal frequencies when a flashback condition has developed or is developing in the combustion system 103. These abnormal frequencies may have values that are known or are ascertainable through ordinary experimentation. For example, the abnormal frequencies may be determined by operating the combustion system 103 during a flashback event, obtaining an abnormal acoustic pressure signal from the combustor 106, and analyzing the abnormal acoustic pressure signal to identify the abnormal operating frequencies.

Thereafter, the abnormal frequency information may be accessed by the controller 212 during operation of the system 200 for detecting a flashback condition. For example, the abnormal frequencies may be stored in a program of operation executed by the controller 212 or in a memory accessible to the controller 212. The controller 212 may compare the current operating frequency information with the abnormal frequency information indicative of a flashback condition. In the event that the current operating frequency information matches the abnormal frequency information in whole or in part, the controller 212 may indicate a flashback condition exists in the combustion system 103, such as in one of the fuel nozzles 104.

The embodiments described above may be combined and varied as appropriate. For example, the controller 212 may indicate the flashback condition exists in response to any one of the current operating frequencies substantially differing from each of the baseline frequencies. As another example, the controller 212 may indicate the flashback condition exists in response to any one of the current operating frequencies substantially matching any one of the abnormal frequencies. Combinations of these examples may also be employed. In some cases, the controller 212 may be aware of both the baseline frequency information and the abnormal operating frequency information, in which case the controller 212 may employ either or both sets of information for comparison purposes. Further, ranges of acceptable frequencies may be set based on the baseline frequency information, and ranges of unacceptable frequencies may be set based on the abnormal frequency information. In such cases, the controller 212 may indicate the flashback condition exists in response to a comparison of the current operating frequency information with the ranges. For example, the controller 212 may indicate the flashback condition exists if any one current operating frequency falls outside of each range of acceptable baseline frequencies or falls inside any one range of unacceptable abnormal frequencies.

In embodiments, the system 200 may also store, detect, and compare amplitudes of the detected frequencies and the known baseline or abnormal frequencies. In such embodiments, the controller 212 may indicate a flashback condition exists when a current operating frequency, which is at or near one of the known abnormal frequencies or is substantially far from any of the known normal frequencies, experiences a sharp rise in amplitude. In such embodiments, the system 200 may be relatively more robust. More specifically, a sharp rise in amplitude coupled with the detection of at least one anomalous dominant frequency may serve as a more definitive indicator of the occurrence of a flashback condition. In such embodiments, pre-determined amplitude thresholds may be set. These amplitude thresholds may be accessed by the controller 212 during operation of the system 200 for comparison purposes. The controller 212 may indicate a flashback condition exists in the combustion system 103 if a current operating frequency, which is at or near one of the known abnormal frequencies and/or is substantially far from any of the known normal frequencies, has an amplitude that exceeds the set threshold.

Although amplitude monitoring may serve as a robust indicator of a flashback condition, it may be difficult to monitor sharp rises in amplitude in cases in which a substantial noise is present in the acoustic pressure signal. Noise in the acoustic pressure signal may result from a variety of causes, such as vibration within the combustor 106. Thus, the controller 212 may be operable to filter noise from the acoustic pressure signal, to remove frequencies associated with vibrations or other effects unrelated to flashback. For example, the controller 212 may include a band pass filter, a notch filter, or combinations of these and other filters. A notch filter may be used if the dominant frequencies in the acoustic pressure signal are closely spaced.

It should be noted that the baseline and abnormal frequency and amplitude information may vary with each combustor 106 or combustion system 103, either at the individual level or at the model level.

As mentioned above, the controller 212 may employ a signal processing technique to analyze the detected acoustic pressure signal in the frequency domain. Any technique that permits resolving the dominant frequencies present in the acoustic pressure signal may be used. Some suitable techniques, such as fast Fourier transform, may not provide information regarding when in time the dominant frequencies occurred. Thus, in some embodiments, the controller 212 may employ a signal processing technique that is able to or identify a window or point in time at which a certain frequency occurred. An example is windowed Fourier transform, which may limit the frequency domain analysis to certain spatial windows. In such cases, relatively larger time windows may be employed to resolve relatively lower detected frequencies, while relatively smaller time windows may be used to resolve relatively higher detected frequencies. Another example is wavelet transform, which may provide information regarding when in time a detected frequency occurred. Knowledge of the window or point in time when a certain frequency occurred may be helpful in preventing recurring flashback conditions during repeated operations of a given gas turbine engine under similar operating conditions.

It should be noted that flashback conditions may be correlated with frequency shifts or changes in the acoustic pressure signal for a variety of reasons. For example, in embodiments in which the combustor 106 operates on lean pre-mixed combustion, the combustion flame may burn on the border of extinguishing for lack of fuel. Such burning may result in heat release oscillations in the combustor 106, which may excite the acoustic modes of the combustor 106, causing pressure oscillations or pulsations of relatively large amplitude. These pressure pulsations may travel upstream from the combustor 106 into the fuel nozzles 104, creating an oscillating pressure drop across the fuel nozzles 104. Oscillating delivery of the fuel into the combustor 106 may result in the propagation of a fuel concentration wave downstream in the fuel nozzles 104. If the fuel concentration wave resides in the fuel nozzle 104 for a sufficient period of time, the increased temperature in the fuel nozzle 104 may auto-ignite the air-fuel mixture, even in the absence of a conventional ignition means. Thus, a flashback condition in the fuel nozzle 104 may result.

As another example, a flashback condition in the fuel nozzle 104 may result from combustion-induced vortex breakdown. During combustion, swirling flows in the combustor 106 may give rise to vortices, which may travel upstream into the fuel nozzles 104. Oscillations in the vortices may lead to vortex breakdown inside the fuel nozzles 104, resulting in low pressure zones inside the fuel nozzles 104. As a result of the pressure gradient, the combustion flame may propagate upstream into the fuel nozzle 104. In these and in other instances, the flashback condition in the fuel nozzle 104 may be marked by certain frequencies of pressure oscillations, which may be embodied in the acoustic pressure signal obtained from the combustor 106.

Figure 2:
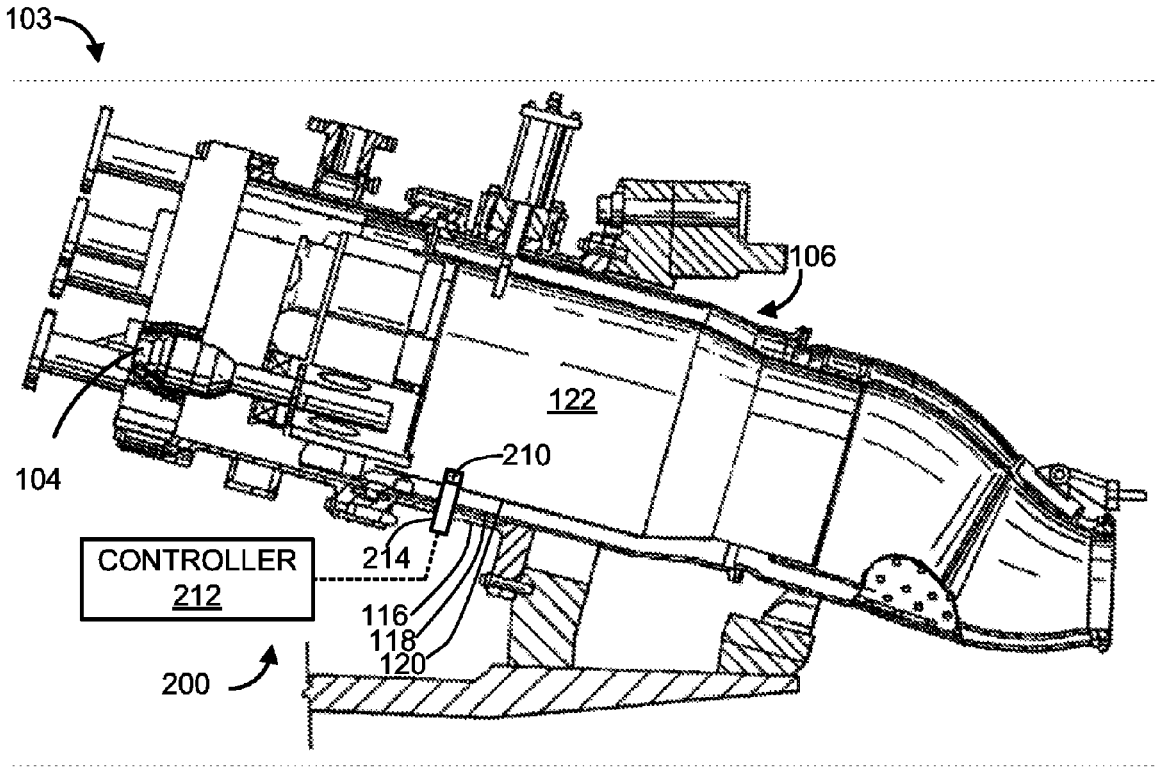
FIG. 2 is cross-sectional view of an embodiment of a combustor, illustrating an embodiment of a system for detecting a flashback condition in a fuel nozzle of a combustor.

FIG. 2 is cross-sectional view of an embodiment of a combustion system 103, illustrating an embodiment of a system 200 for detecting a flashback condition in a fuel nozzle 104 of the combustion system 103. In embodiments, the system 200 may be implemented with reference to a dry low NOx combustion system, in which case the fuel nozzle 104 may be a pre-mixer nozzle, although other configurations are possible.

In embodiments, the system 200 may include a probe 214 associated with the combustor 106 as shown in FIG. 2. Specifically, the probe 214 may extend through a combustion casing 116, a flow sleeve 118, and a combustion liner 120, and into a combustion chamber 122. The probe 214 may include the sensor 210 for detecting the acoustic pressure signal, and in some cases, the controller 212 for analyzing the detected signal and indicating the flame condition. Alternatively, the controller 212 may be separate from the probe 214 as shown.

As shown in FIG. 2, the acoustic pressure sensor 210 may be positioned on a portion of the probe 214 that becomes positioned in the combustion chamber 122. The positioning of the acoustic pressure sensor 210 is selected to detect pressure pulsations produced in the combustor chamber 122 due to a fluid flow near the combustion flame. The acoustic pressure sensor 210 then sends an electric signal to the controller 212, which includes a signal processor.

The probe 214 may reduce the cost of retrofitting the gas turbine 100 with the system 200, as the probe 214 may detect a flashback condition in any one of the fuel nozzles 104 by detecting the acoustic pressure signal within the combustion chamber 122. Thus, individual sensors may not be needed within each fuel nozzle 104, reducing implementation and maintenance costs.

In embodiments, the probe 214 may be associated with an existing probe of the gas turbine 100, such as existing equipment that monitors the combustion dynamics within the combustor 106. An example of such equipment is a combustor dynamics monitoring (CDM) probe, which monitors dynamic pressure waves within the combustion chamber 122. In such embodiments, retrofitting a gas turbine 100 with the probe 214 may be as simple as replacing the existing CDM probe with the probe 214 that includes the sensor 210 and the controller 212, or alternatively, attaching an existing CDM probe that includes an acceptable sensor 210 to an embodiment of the controller 214 described above.

Figure 3:
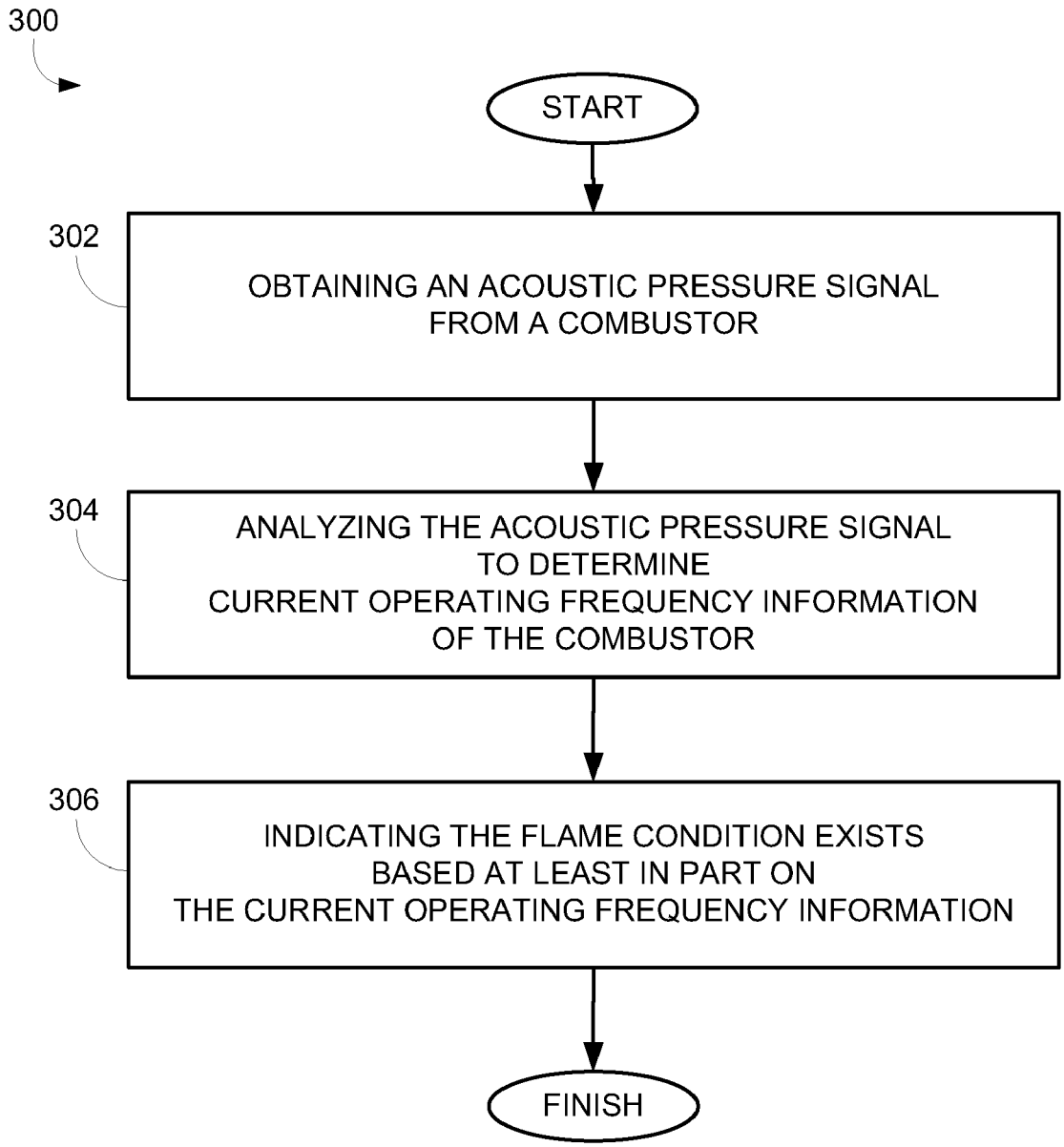
FIG. 3 is a block diagram illustrating an embodiment of a method of detecting a flashback condition in a fuel nozzle of a combustor.

FIG. 3 is a block diagram illustrating an embodiment of a method for detecting a flame condition in a fuel nozzle of a combustor. In block 302, an acoustic pressure signal is obtained from the combustor. The combustor may be, for example, a dry low NOx combustor. In embodiments, the combustor may employ a relatively reactive fuel, such as hydrogen. The acoustic pressure signal may be obtained from the combustor using an acoustic pressure sensor, probe, transducer, or microphone. In embodiments, the acoustic pressure signal may be obtained using a combustion dynamics monitoring probe, which monitors dynamic pressure waves in the combustor.

In block 304, the acoustic pressure signal is analyzed to determine current operating frequency information of the combustor. The current operating frequency information may include one or more dominant frequencies present in the acoustic pressure signal. These dominant frequencies may represent frequencies of pressure waves propagating through the combustion system during current operation. The analysis may be performed with a controller, such as a signal processor. The analysis may include one or more signal processing techniques operable to represent the acoustic pressure signal in the frequency domain. Example signal processing techniques include fast Fourier transform, short-term Fourier transform, windowed Fourier transform, wavelet transform, or LaPlace transform, although others techniques or combinations thereof may be employed. In embodiments, analyzing the acoustic pressure signal may further include filtering the acoustic pressure signal to remove noise, such as vibrations. In such embodiments, the acoustic pressure signal may be filtered before the signal processing technique is performed. In embodiments, analyzing the acoustic pressure signal may further include determining an amplitude associated with each dominant frequency in the current operating frequency information.

In block 306, a flashback condition is indicated based at least in part on the current operating frequency information. The flashback condition may be indicated in response to a comparison of the current operating frequency information with one or more of the following: baseline frequency information indicative of normal operation or abnormal frequency information indicative of a flashback condition. In embodiments, the flashback condition may be indicated in response to the current frequency information substantially differing in whole or in part from baseline frequency information indicative of normal operation. For example, the flashback condition may be indicated in response to one of the dominant frequencies in the current operating frequency information substantially differing from each of the dominant frequencies in baseline frequency information. In such embodiments, the method 300 may further include obtaining the baseline frequency information from the combustor during normal operation, meaning when the combustion system is known to not be experiencing a flashback condition. For example, the combustion system may be operated under normal conditions, a baseline acoustic pressure signal may be obtained, and the baseline acoustic pressure signal may be analyzed to determine one or more dominant frequencies associated with normal operation of the combustion system. The method 300 may then compare the current operating frequencies to the baseline operating frequencies to determine whether at least one current operating frequency differs from each of the baseline frequencies.

In other embodiments, the flashback condition may be indicated in response to the current operating frequency information substantially corresponding in whole or in part to abnormal frequency information indicative of a flashback condition. For example, the flashback condition may be indicated in response to one of the dominant frequencies in the current operating frequency information substantially matching one of the dominant frequencies in the abnormal frequency information. In such embodiments, the method 300 may further include obtaining the abnormal frequency information from the combustor during abnormal operation, meaning when the combustion system is known to be experiencing a flashback condition in the fuel nozzle. For example, the combustion system may be operated under abnormal conditions, an abnormal acoustic pressure signal may be obtained, and the abnormal acoustic pressure signal may be analyzed to determine one or more dominant frequencies associated with abnormal operation of the combustion system. The method 300 may then compare the current operating frequencies to the abnormal operating frequencies to determine whether one of the current operating frequencies matches one of the abnormal frequencies.

These two alternatives may also be combined and varied to accomplish the desired ability to indicate a flashback condition. Further, it should be noted that ranges of frequencies may be set based on the baseline and abnormal frequency information, in which case the flashback condition may be indicated in response to the current operating frequencies falling outside of the acceptable range of baseline frequencies, falling inside the unacceptable range of abnormal frequencies, or a combination thereof.

Also, in embodiments the method 300 may consider amplitudes of the frequencies. For example, in block 304 the acoustic pressure signal may be analyzed to determine one or more current operating frequencies, and an amplitude for each frequency. In such cases, in block 306 the flashback condition may be indicated in response to a comparison of the amplitudes of the current operating frequencies with the amplitudes of one or more baseline or abnormal frequencies, as appropriate. It should be noted that amplitude thresholds may be set based on the baseline and abnormal frequency information, in which case the flame condition may be indicated in response to the amplitude of the current operating frequencies falling above a permissible threshold amplitude. A person of skill could implement a range of configurations based on the above disclosure, each configuration being included in the scope of the present disclosure.

The written description uses examples to disclose the invention, including the best mode, and also enabled any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

At least the following is claimed:

1. A method of detecting a flashback condition in a fuel nozzle of a combustor, the method comprising:

obtaining a current acoustic pressure signal from the combustor;

analyzing the current acoustic pressure signal to determine current operating frequency information for the combustor; and detecting that the flashback condition exists based at least in part on the current operating frequency information.

2. The method of claim 1, wherein obtaining a current acoustic pressure signal from the combustor comprises detecting acoustic pressure waves within the combustor with a device that comprises one or more of the following: a sensor, a probe, a transducer, and a microphone.

3. The method of claim 1, wherein analyzing the current acoustic pressure signal comprises performing a signal processing technique operable to represent the current acoustic pressure signal in the frequency domain.

4. The method of claim 3, wherein the signal processing technique is selected from the group consisting of: fast Fourier transform, short-term Fourier transform, windowed Fourier transform, wavelet transform, and Laplace transform.

5. The method of claim 1, further comprising:

obtaining a baseline acoustic pressure signal from the combustor during normal operation; and analyzing the baseline acoustic pressure signal to determine baseline operating frequency information for the combustor.

6. The method of claim 5, wherein detecting that the flashback condition exists comprises:

comparing the current operating frequency information to the baseline operating frequency information; and indicating that the flashback condition exists in response to one or more dominant frequencies of the current operating frequency information differing from dominant frequencies of the baseline operating frequency information.

7. The method of claim 1, further comprising:

obtaining an abnormal acoustic pressure signal from the combustor during development of a flashback condition; and analyzing the abnormal acoustic pressure signal to determine abnormal operating frequency information for the combustor.

8. The method of claim 7, wherein detecting that the flashback condition exists comprises:

comparing the current operating frequency information to the abnormal operating frequency information; and indicating that the flashback condition exists in response to one or more dominant frequencies of the current operating frequency information substantially matching one or more dominant frequencies of the abnormal operating frequency information.

9. The method of claim 1, wherein analyzing the current acoustic pressure signal further comprises filtering the acoustic pressure signal.

10. The method of claim 1, wherein:

analyzing the current acoustic pressure signal further comprises determining current operating frequency and amplitude information for the combustor; and detecting that the flashback condition exists in the combustor comprises comparing the current operating frequency and amplitude information to one or more of the following: baseline frequency and amplitude information associated with normal operation of the combustor and abnormal operating frequency and amplitude information associated with a flashback condition in the combustor.

11. A system for detecting a flashback condition, the system comprising:

a sensor operable to detect an acoustic pressure signal in a combustor; and a controller operable to:

analyze the detected acoustic pressure signal to identify a current operating frequency; and detecting a flashback condition exists in response to the current operating frequency falling outside of a range of baseline frequencies associated with normal combustor operation.

12. The system of claim 11, wherein the sensor further comprises a transducer.

13. The system of claim 11, wherein the sensor is positioned in a combustor chamber of the combustor.

14. The system of claim 11, wherein the sensor is associated with an existing combustion dynamics monitoring probe.

15. The system of claim 11, wherein the controller comprises a signal processor operable to determine one or more frequencies present in the acoustic pressure signal.

16. A system for detecting a flame condition, the system comprising:

a sensor operable to detect an acoustic pressure signal in a combustor; and a controller operable to:

analyze the detected acoustic pressure signal to identify a current operating frequency; and detecting a flashback condition exists in response to the current operating frequency falling within a range of abnormal frequencies associated with a flashback condition.

17. The system of claim 16, wherein the sensor further comprises a transducer.

18. The system of claim 16, wherein the sensor is positioned in a combustor chamber of the combustor.

19. The system of claim 16, wherein the sensor is associated with an existing combustion dynamics monitoring probe.

20. The system of claim 16, wherein the controller comprises a signal processor operable to determine one or more frequencies present in the acoustic pressure signal.

* * * * *